US007543598B1

(12) United States Patent
Hygema

(10) Patent No.: US 7,543,598 B1
(45) Date of Patent: Jun. 9, 2009

(54) VACUUM BREAK THERMISTOR HOUSING

(75) Inventor: Terry L. Hygema, Yonker, NY (US)

(73) Assignee: Group Dekko, Inc., Kendallville, IN (US)

( * ) Notice: Subject to any disclaimer, the term of this patent is extended or adjusted under 35 U.S.C. 154(b) by 235 days.

(21) Appl. No.: 11/321,355

(22) Filed: Dec. 29, 2005

(51) Int. Cl.
*E03C 1/10* (2006.01)

(52) U.S. Cl. ..... 137/216; 236/12.11; 236/93 R; 73/866.5; 374/147; 374/163

(58) Field of Classification Search ..... 137/216; 236/12.11, 93 R; 73/431, 866.5; 374/147, 374/148, 163, 208
See application file for complete search history.

(56) References Cited

U.S. PATENT DOCUMENTS

| | | | | | |
|---|---|---|---|---|---|
| 3,707,857 | A * | 1/1973 | Wigfall | 68/12.27 |
| 3,824,461 | A | 7/1974 | Preikschat | 324/61 |
| 3,983,753 | A * | 10/1976 | Greenleaf et al. | 600/549 |
| 4,411,537 | A * | 10/1983 | Grimm | 374/185 |
| 4,449,035 | A * | 5/1984 | Schwob | 219/251 |
| 4,643,350 | A * | 2/1987 | DeSchaaf et al. | 236/12.12 |
| 4,859,422 | A | 8/1989 | Qureshi et al. | 422/81 |
| 5,010,264 | A | 4/1991 | Yamada et al. | 310/72 |
| 5,291,898 | A | 3/1994 | Wolf | 128/719 |
| 5,993,061 | A * | 11/1999 | Drouet | 374/208 |
| 6,064,801 | A | 5/2000 | Stokes et al. | 392/501 |
| 6,069,998 | A | 5/2000 | Barnes et al. | 392/498 |
| 6,534,012 | B1 | 3/2003 | Hazen et al. | 422/82.05 |
| 6,550,962 | B1 * | 4/2003 | Yang et al. | 374/147 |
| 6,675,912 | B2 | 1/2004 | Carrier | 173/217 |
| 2004/0151230 | A1 * | 8/2004 | Das et al. | 374/141 |

* cited by examiner

*Primary Examiner*—John Rivell
*Assistant Examiner*—Craig M Schneider
(74) *Attorney, Agent, or Firm*—Taylor & Aust, P.C.

(57) ABSTRACT

A vacuum break assembly including a housing and a sensor assembly. The housing has a pocket therein, the pocket having a wall. The sensor assembly includes a spring beam and a thermal sensor held against the wall of the pocket by force from the spring beam.

14 Claims, 6 Drawing Sheets

VACUUM BREAK THERMISTOR HOUSING

BACKGROUND OF THE INVENTION

1. Field of the Invention

The present invention relates to a thermal sensor in a vacuum break, and, more particularly, to a thermistor assembly in a vacuum break.

2. Description of the Related Art

Vacuum breaks are utilized in water systems in order to prevent a siphoning action from occurring between a device utilizing water and the water supply. For example, vacuum breaks are utilized in certain toilet flushing systems so that there is an opportunity for air to enter between the water source and the water being used by the device. Another application for vacuum breaks are in wash machines where the water supply may be a mixture of hot and cold water that is then supplied to a washing tub with the vacuum break serving the dual function of mixing the hot and cold water in a mixing chamber and providing a break between the water supply and the water in the washing tub. Vacuum breaks for washing machines allow for the introduction of atmospheric air in the water flow so that a siphon is not created that would draw additional water from the source or allow contamination from a water path that may be in contact with water in the tub and the valve. Contamination risk is greatest if water pressure from the water source is lost and the valve is opened and if the valve is in contact with water from the wash tub contamination of the source water would result. For this reason a vacuum break is utilized to prevent the possibility of a water source contamination. Additionally the vacuum break may allow a mixing of the water from the water sources prior to the water being utilized in the washing tub.

Vacuum breaks have water valve assemblies associated therewith, which may be attached thereto. The water valve assemblies are controlled by control systems that receive temperature information from a sensor, which detects that temperature of the mixed water.

What is needed in the art is an inexpensive, easily assembled temperature sensor for use in a vacuum break.

SUMMARY OF THE INVENTION

The present invention, in one form thereof, comprises a vacuum break assembly including a housing having a pocket therein and a sensor assembly. The sensor assembly includes a spring beam and a thermal sensor held against a wall of the pocket by way of force from the spring beam.

An advantage of the present invention is that the sensor assembly is easily attached to the housing of the vacuum break.

Yet another advantage of the present invention is that the thermistor is held in contact with a wall of a mixing chamber, thereby ensuring good thermal contact therebetween.

Yet another advantage of the present invention is that a spring arm is used to provide force to the thermistor and to serve as a pivot point for an over-center assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
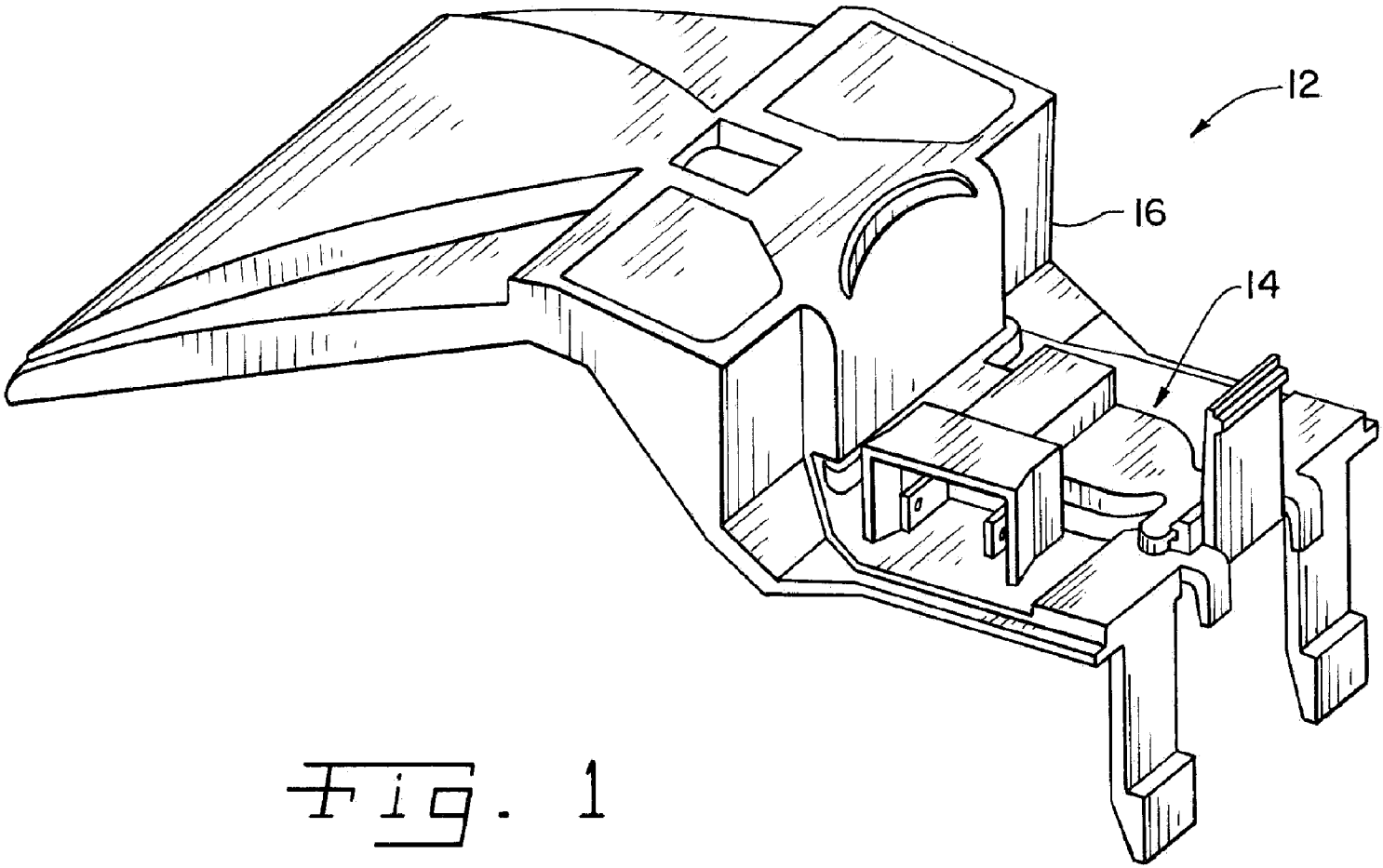
FIG. 1 is a perspective view of an embodiment of a vacuum break assembly of the present invention.
Figure 2:
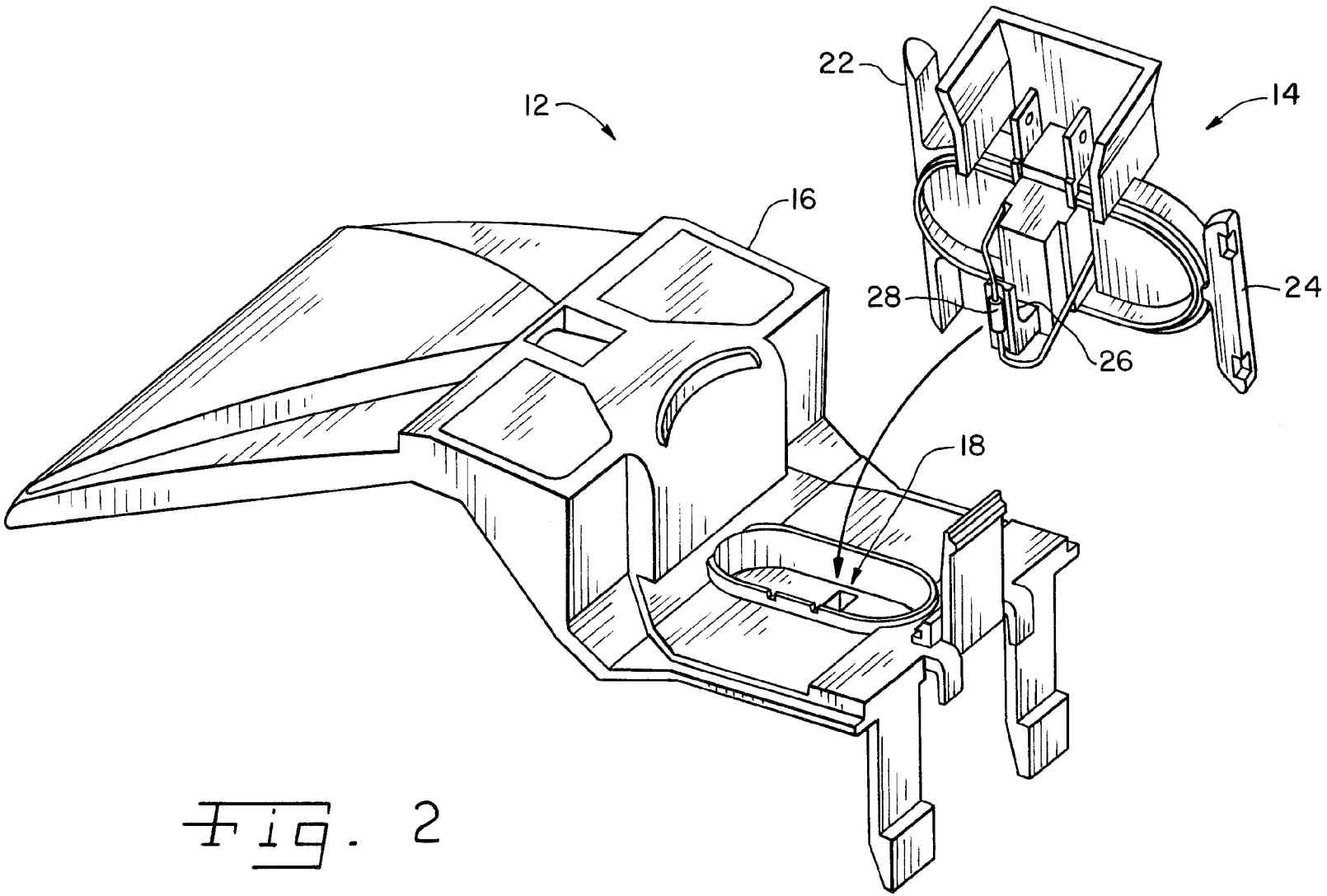
FIG. 2 is an exploded view of the vacuum break of FIG. 1 separately illustrating a sensor assembly of the present invention.
Figure 3:
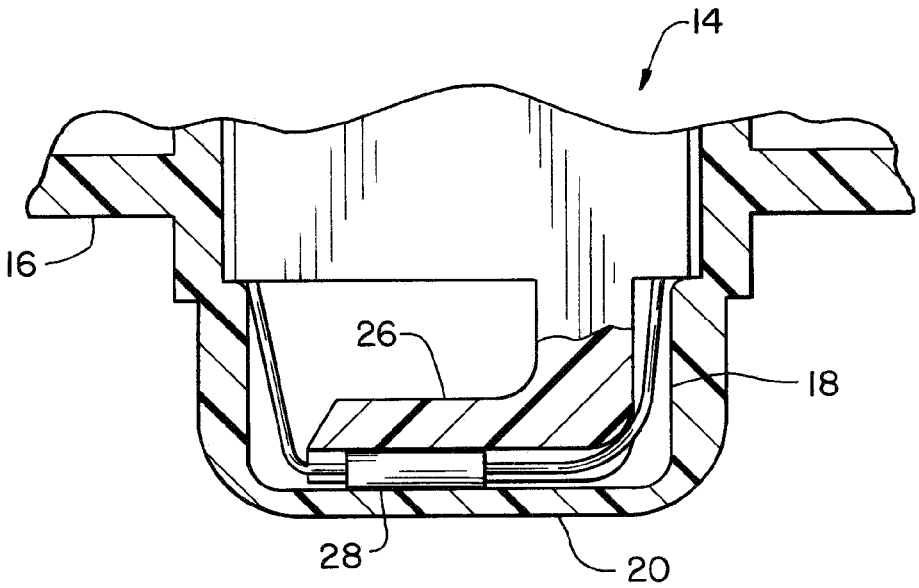
FIG. 3 is a partially cross-sectioned view of the thermal sensor of FIGS. 1 and 2 contained in the housing of FIGS. 1 and 2.
Figure 4:
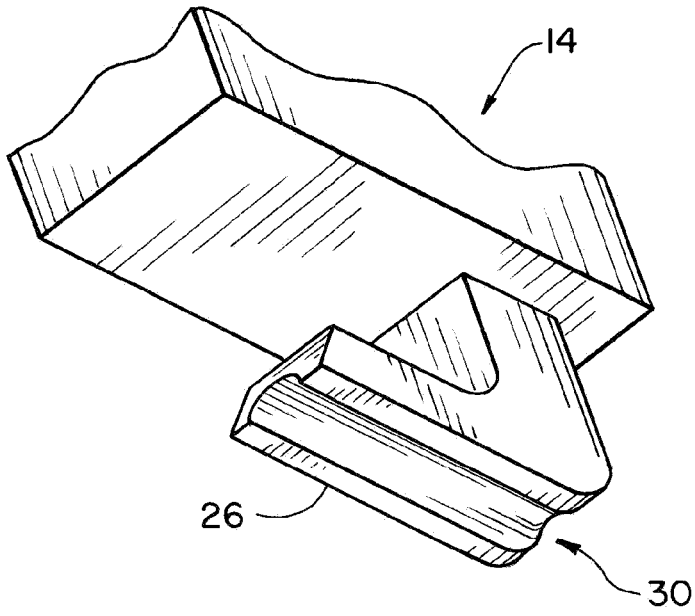
FIG. 4 is a perspective view of a portion of the sensor assembly of FIGS. 1-3.
Figure 5:
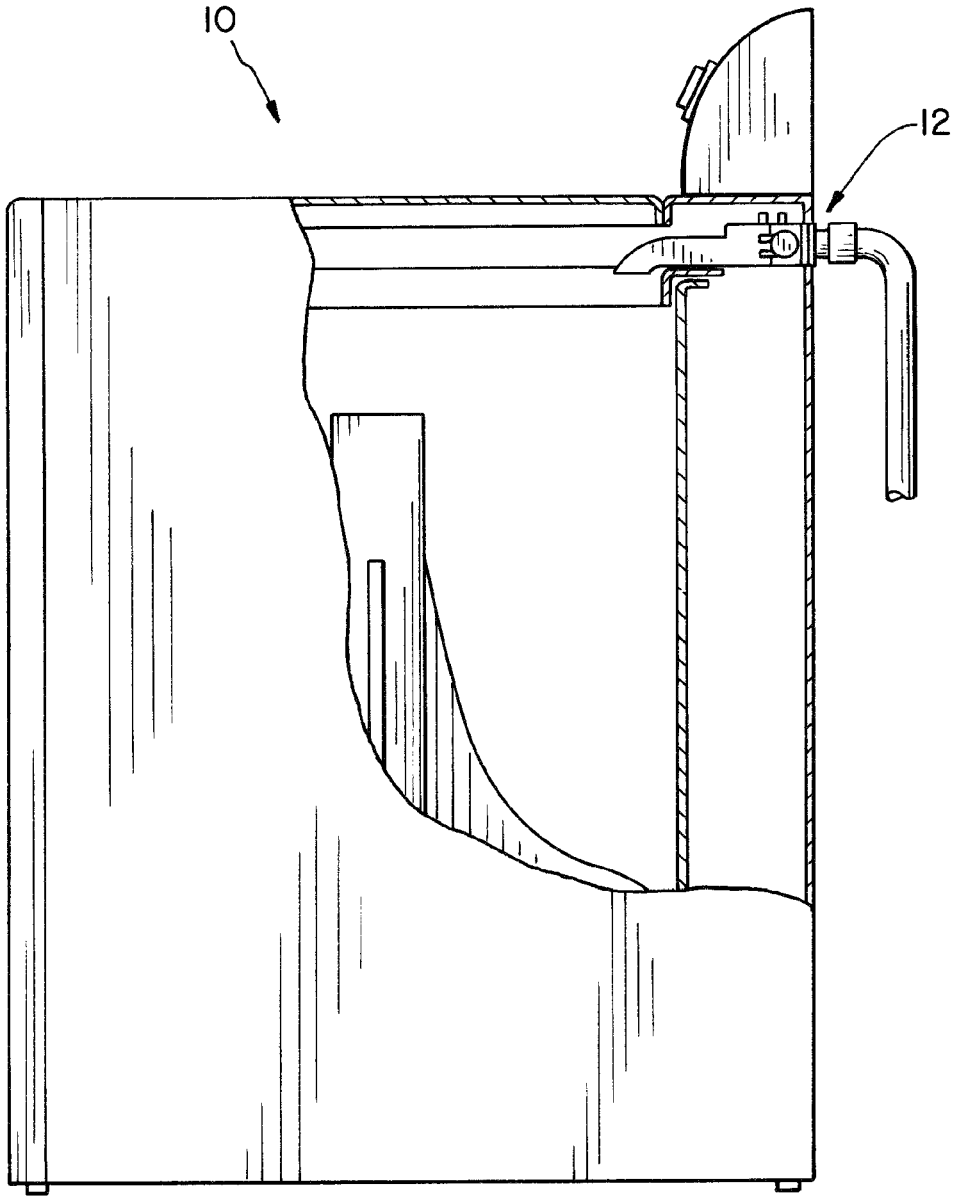
FIG. 5 is a partially cross-sectioned view of a washing machine utilizing the vacuum break of the present invention.

Referring now to the drawings, and more particularly to FIGS. 1-5, there is shown a washing machine 10 utilizing a vacuum break assembly 12. Vacuum break assembly 12 has connected therewith a thermal sensor assembly 14. Thermal sensor assembly 14 is in thermal contact with a mixing chamber where hot and cold water meet in vacuum break assembly 12 so that a mixing of proper amounts of the hot and cold water can be controlled by a control unit, not shown.

Vacuum break assembly 12 includes a housing 16 having a pocket 18 with a wall 20. Pocket 18 forms a portion of a wall of the mixing chamber and may include a thin portion that specifically allows quick thermal conduction from the water in the mixing chamber to thermal sensor assembly 14. Pocket 18 has a wall 20, which is a common wall between the mixing chamber and pocket 18.

Thermal sensor assembly 14 includes a pivoting feature 22, a latch 24, a spring arm 26 and a thermistor 28. Pivot 22 is inserted under a portion of housing 16 and thermal sensor assembly 14 is held in place by way of a latch 24. Latch 24 detachably connects with a feature on housing 16 to hold thermal sensor assembly 14 in position. Spring arm 26 is connected at one end to thermal sensor assembly 14 and is resilient, so as to provide a counter force when pressure is applied thereagainst. Thermistor 28 is positioned in a groove 30 of spring arm 26 and the tolerances between thermal sensor assembly 14 and housing 16 are such that pressure is applied against thermistor 28 by way of spring arm 26 when latch 24 is in position relative to housing 16.

Thermistor 28 is electrically connected to terminals on thermal sensor assembly 14 which are interconnected electrically with the control system, which uses information from thermistor 28 to determine the duration and/or volume of water respectively from a hot and cold water source to admit to the mixing chamber to result in the desired temperature of water flowing from vacuum break assembly 12 to a washing tub in washing machine 10. Thermistor 28 has a variable conductivity relative to the temperature of thermistor 28 and it is this relative conductivity that allows the control system to measure the temperature of the mixed water in the mixing chamber.

A biasing force is provided by spring arm 26 to hold thermistor 28 against wall 20. Spring arm 26 is in direct contact with thermistor 28 to apply the force thereto. Spring arm 26 may be made of a relatively non-thermally conductive material so as to not influence the temperature of thermistor 28.

Figure 6:
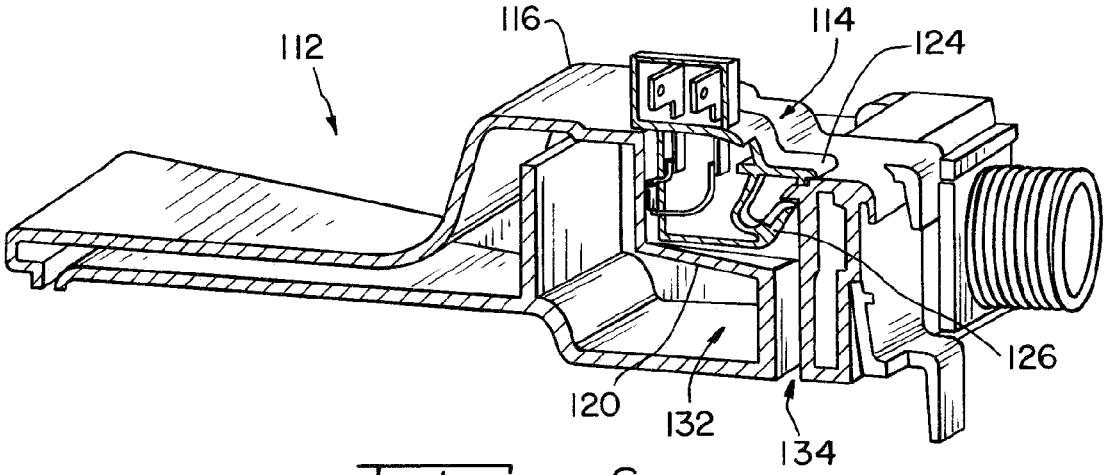
FIG. 6 is a partially cross-sectioned perspective view of another embodiment of a vacuum break assembly of the present invention.
Figure 7:
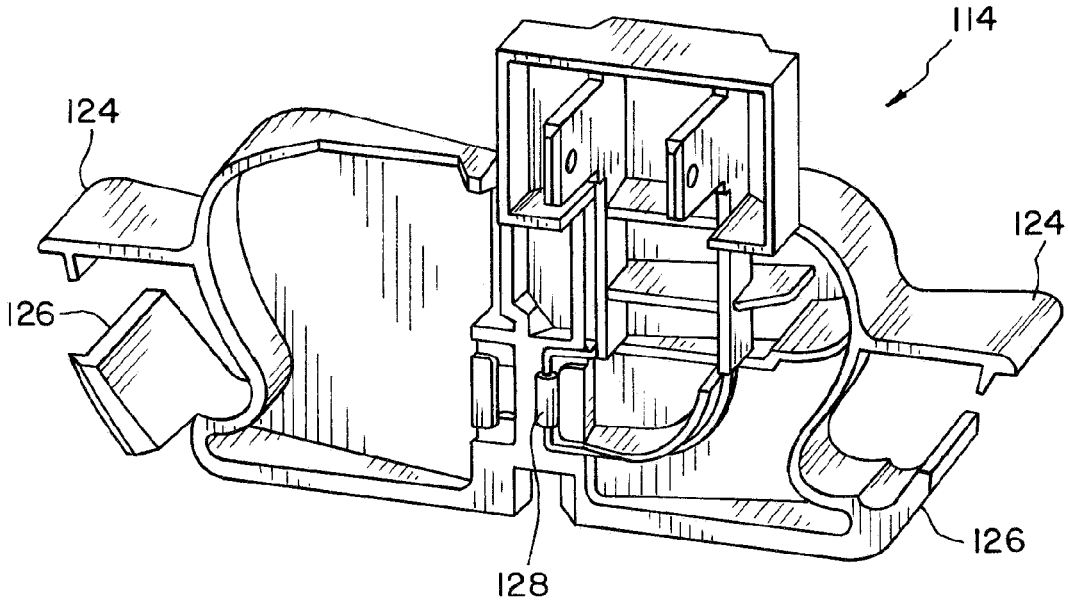
FIG. 7 is an internal view of a sensor assembly of vacuum break of FIG. 6.
Figure 8:
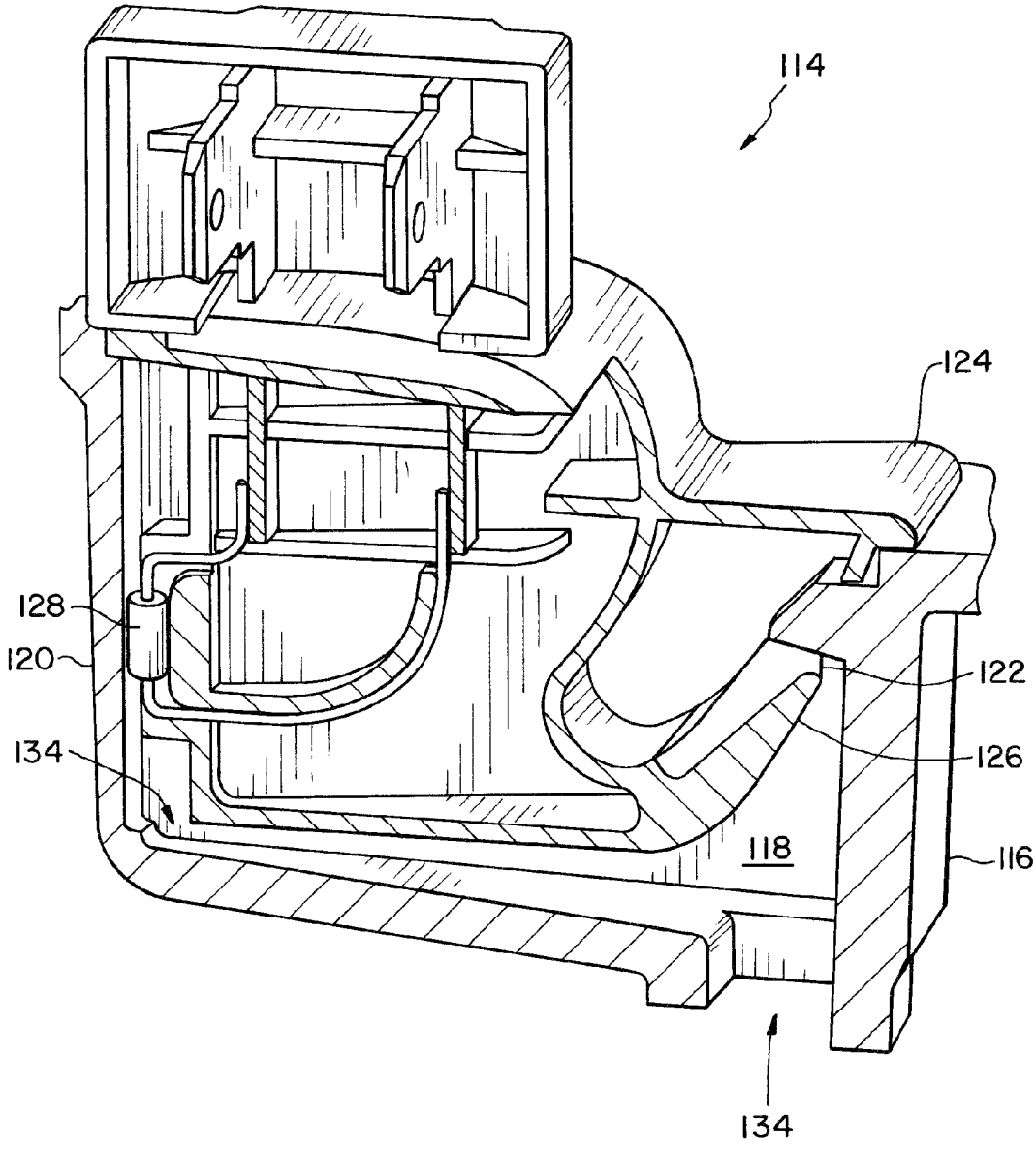
FIG. 8 is a partially cross-sectioned perspective view of the sensor assembly of FIGS. 6 and 7 in the housing of the vacuum break of FIG. 6.

Now, additionally referring to FIGS. 6-8 there is shown another embodiment of a vacuum break assembly 112 of the present invention. The elements of vacuum break assembly 112 are significantly similar to those of vacuum break assembly 12 and the elements are provided with similar numbers advanced by one hundred. Vacuum break assembly 112 has a thermal sensor assembly 114 connected to housing 116. Housing 116 includes a pocket 118 with a wall 120. Wall 120 may be thin in order to allow quick thermal conductivity therethrough.

Thermal sensor assembly 114 includes a pivot 122, a latch 124, a spring arm 126 and a thermistor 128. In this embodiment spring arm 126 is remote from thermistor 128, yet spring arm 126 provides a biasing force to thermistor 128, by pressing thermistor 128 against wall 120. Pivot 122 is located at an end of spring arm 126 and serves to provide an over-center biased condition to thermal sensor assembly 114 when it is installed into housing 116. Pivot 122 is inserted into pocket 118 and thermal sensor assembly 116 is rotated into position causing spring arm 126 to flex and provide a biasing force as thermal sensor assembly 114 is rotated into position. When thermal sensor assembly 114 is in position, as shown in FIG. 6, thermal sensor assembly 114 is in an over-center configuration with spring arm 126 co-acting to provide a biasing force to hold assembly 114 in position and also providing a pivot 122 thereby keeping assembly 114 in the over-center position. To ensure that assembly 114 remains attached to housing 116, latch 124 has a protrusion that interacts with a groove in housing 116 to hold assembly 114 in position.

Wall 120 forms a boundary for a portion of mixing chamber 132, within which water is supplied of both a hot and cold temperature in the proportions that result in a desired temperature. The water leaves housing 116 over an interior wall in vacuum break assembly 112. The temperature of the water in mixing chamber 132 is thermally transferred through wall 120 and the temperature is sensed by thermistor 128 by way of changing conductivity, which is directly related to the temperature of the water in mixing chamber 132.

A drainage channel 134 leads from thermistor 128 along a pathway allowing the discharge of any moisture, which may collect proximate to thermal sensor 114. Drainage channel 134 is at least partially defined by a portion of thermal sensor assembly 114 and housing 116 when in an assembled condition.

FIG. 7 illustrates one alternative manner in which thermal sensor assembly 114 can be assembled by way of a clam shell design holding thermistor 128 in a thermistor pocket proximate to a hinged portion of the clam shell configuration. Spring arm 126 include two portions that are snapped together to form spring arm 126 and to also serve to hold the clam shell housing as a enclosed unit. The bifurcated nature of spring arm 126 works together to provide the biasing force against thermistor 128 when holding it against wall 120. Latch 124 also has a resilient spring-type latch 124 allowing it to be lifted and assembly 114 rotated out of housing 116 if it is needed to replace sensor assembly 114.

Advantageously the present invention provides a biasing force against a thermistor while easily moving the sensor assembly into a latched position without the need of any tools to accomplish the assembly process. The biasing force against the thermistor improves the rapidity in which the thermistor responds to the temperature of the water in the mixing chamber since thermal transfer of the heat from the water in the mixing chamber in enhanced.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vacuum break assembly, comprising:

a housing of the vacuum break assembly having a pocket therein and including a wall defining said pocket; and a sensor assembly including:

a spring beam having a groove therein, said groove being an elongate channel in a surface of said spring beam; and a thermal sensor held in said pocket against said wall defining said pocket by force from said spring beam, said elongate channel contacting said thermal sensor and accommodating a shape of said thermal sensor.

2. The vacuum break assembly of claim 1, wherein said thermal sensor is a thermistor.

3. The vacuum break assembly of claim 1, wherein said channel has a hemispherical cross-section.

4. The vacuum break assembly of claim 1, wherein said housing additionally includes a water mixing chamber with said wall defining said pocket defining a portion of a boundary of said water mixing chamber.

5. The vacuum break assembly of claim 4, wherein there is a passageway from said thermal sensor between said wall and said sensor assembly to a point of exit from said housing such that any moisture that may be proximate to said thermal sensor will drain along said passageway.

6. The vacuum break assembly of claim 1, wherein said spring beam co-acts to provide said force and to serve as a pivot-point holding said sensor assembly in an over-center position relative to said housing.

7. The vacuum break assembly of claim 6, further comprising a latch holding said sensor assembly in said over-center position.

8. A washing machine, comprising:

an enclosure; and a vacuum break assembly supported by said enclosure, said vacuum break assembly including:

a housing having a pocket therein and including a wall defining said pocket; and a sensor assembly including:

a spring beam having a groove therein, said groove being an elongate channel in a surface of said spring beam; and a thermal sensor held in said pocket against said wall defining said pocket by force from said spring beam, said elongate channel contacting said thermal sensor and accommodating a shape of said thermal sensor.

9. The washing machine of claim 8, wherein said thermal sensor is a thermistor.

10. The washing machine of claim 8, wherein said channel has a hemispherical cross-section.

11. The washing machine of claim 8, wherein said housing additionally includes a water mixing chamber with said wall defining said pocket defining a portion of a boundary of said water mixing chamber.

12. The washing machine of claim 11, wherein there is a passageway from said thermal sensor between said wall and said sensor assembly to a point of exit from said housing such that any moisture that may be proximate to said thermal sensor will drain along said passageway.

13. The washing machine of claim 8, wherein said spring beam co-acts to provide said force and to serve as a pivot-point holding said sensor assembly in an over-center position relative to said housing.

14. The washing machine of claim 13, further comprising a latch holding said sensor assembly in said over-center position.

* * * * *